US010133240B2

(12) United States Patent
Jeanneret et al.

(10) Patent No.: US 10,133,240 B2
(45) Date of Patent: Nov. 20, 2018

(54) OSCILLATOR FOR TIMEPIECE MOVEMENT

(71) Applicant: Marc André Jeanneret, Bôle (CH)

(72) Inventors: Marc André Jeanneret, Bôle (CH); Salvatore Stefano Stifani, La Chaux-de-Fonds (CH)

(73) Assignee: Marc André Jeanneret, Bôle (CH)

( * ) Notice: Subject to any disclaimer, the term of this patent is extended or adjusted under 35 U.S.C. 154(b) by 0 days.

(21) Appl. No.: 15/536,063

(22) PCT Filed: Dec. 18, 2015

(86) PCT No.: PCT/EP2015/080679
§ 371 (c)(1),
(2) Date: Jun. 14, 2017

(87) PCT Pub. No.: WO2016/097384
PCT Pub. Date: Jun. 23, 2016

(65) Prior Publication Data

US 2018/0004164 A1 Jan. 4, 2018

(30) Foreign Application Priority Data

Dec. 18, 2014 (EP) ..... 14199074

(51) Int. Cl.
*G04B 17/22* (2006.01)
*G04B 17/32* (2006.01)
(Continued)

(52) U.S. Cl.
CPC ..... *G04C 3/047* (2013.01); *G04B 15/00* (2013.01); *G04B 17/32* (2013.01); *G04C 5/005* (2013.01); *G04B 17/22* (2013.01)

(58) Field of Classification Search
CPC ..... G04B 15/00; G04B 15/06; G04B 17/00; G04B 17/20; G04B 17/22; G04B 17/222; G04B 17/32; G04C 3/047; G04C 5/005
See application file for complete search history.

(56) References Cited

U.S. PATENT DOCUMENTS 3,626,691 A * 12/1971 Bonsack ..... G04B 17/063 368/169
3,665,699 A * 5/1972 Challandes ..... G04B 17/063 368/169
(Continued)

FOREIGN PATENT DOCUMENTS

CH 592913 11/1977
CH 704685 9/2012
(Continued)

OTHER PUBLICATIONS

Informational brochure, www.lacotedesmontres.com/actu/La-montre-TAG-Heuer-Pendulum-Concept-avec-le-premier-mouvement-mecanique-sans-spiral-No_7643.htm, Mar. 2010.
(Continued)

*Primary Examiner* — Vit W Miska
(74) *Attorney, Agent, or Firm* — Duane Morris LLP; J. Rodman Steele, Jr.; Gregory M. Lefkowitz

(57) ABSTRACT

The invention concerns an oscillator for a timepiece movement, comprising a staff rigidly connected to a balance carrying first and second bipolar magnets spaced apart from the staff and capable, depending on the angular position of the balance, of being positioned alternately within range of a magnetic field produced by a fixed bipolar magnet, the latter being located on the trajectory of the first and second bipolar magnets and being arranged in such a way that, when one of the bipolar magnets approaches the fixed bipolar magnet, identical polarities are located opposite each other in order to produce a repulsive force. The oscillator further
(Continued)

comprises a pallet assembly and an escape wheel for establishing a kinematic connection between a source of energy of the timepiece movement and the balance staff, and arranged in such a way that the balance is capable of having a sustained periodic oscillating movement of an amplitude greater than 90 degrees.

20 Claims, 2 Drawing Sheets

(51) Int. Cl.

| | |
|---|---|
| ***G04B 15/00*** | (2006.01) |
| ***G04C 5/00*** | (2006.01) |
| ***G04C 3/04*** | (2006.01) |

(56) References Cited

U.S. PATENT DOCUMENTS

| | | | | |
|---|---|---|---|---|
| 3,714,773 | A * | 2/1973 | Diersbock | G04C 3/06 368/162 |
| 3,877,215 | A | 4/1975 | Burkhardt et al. | |
| 4,266,291 | A * | 5/1981 | Obata | G04C 3/061 368/157 |
| 6,730,415 | B2 * | 5/2004 | Shibuya | A44C 27/006 204/192.16 |
| 9,804,570 | B2 * | 10/2017 | Winkler | G04C 5/005 |
| 2003/0137901 | A1 * | 7/2003 | Tokoro | G01C 9/06 368/127 |
| 2007/0201317 | A1 | 8/2007 | Heuer | |
| 2012/0269043 | A1 * | 10/2012 | Baudet | G04C 3/047 368/126 |

FOREIGN PATENT DOCUMENTS

| | | |
|---|---|---|
| DE | 1789976 | 6/1959 |
| DE | 1916664 | 10/1970 |
| FR | 1332107 | 12/1963 |
| FR | 2763404 | 11/1998 |
| SU | 179233 | 2/1966 |
| TW | 352882 | 11/2011 |
| WO | 2006045824 | 5/2006 |
| WO | 2011015498 | 5/2011 |
| WO | 2011051497 | 5/2011 |

OTHER PUBLICATIONS

Informational brochure, www.calibre11.com/grand-carrera-pendulum/, Mar. 23, 2010.
Informational brochure, www.fr.worldtempus.com/article/nouveautes/tag-heuer-carrera-mikropendulums, Apr. 2013.
Informational brochure, www.chronomania.net/forum/board_entry.php?id=132121&PHPSESSID=9c5d0262ce85692d5910d7f40954f286#.Uh72HtA6I9M, Dec. 27, 2010.
Informational brochure, www.electric-watches.co.uk/type/transistorised_balance/esa.php, Feb. 2006.
Informational brochure, www.forumamontres.forumactif.com/t76678-news-tag-heuer-pendulum-concept, Mar. 2010.
Blog, www.debethune-resonique.com/, Sep. 16, 2014.

* cited by examiner

OSCILLATOR FOR TIMEPIECE MOVEMENT

CROSS-REFERENCE TO RELATED APPLICATIONS

This application is a § 371 national stage entry of International Application No. PCT/EP2015/0080679, filed Dec. 18, 2015, which claims priority to European Patent Application No. 14199074.7, filed Dec. 18, 2014, the entire contents of which are incorporated herein by reference.

TECHNICAL FIELD

The present invention relates to an oscillator for a timepiece movement, including an arbor intended to be mounted on a frame element of the clockwork movement to define the rotation axis of a balance comprising a hub secured to a suspended mass, angularly extended, bearing a first bipolar magnet, arranged at a distance from the arbor, the magnetic poles of which are oriented substantially in a tangential direction in reference to the arbor, and able, depending on the angular position of the balance, to be positioned within range of a magnetic field produced by at least one stationary bipolar magnet, secured to a support intended to be assembled to the frame of the clockwork movement, the stationary bipolar magnet being situated on the trajectory of the first bipolar magnet as defined by the rotation of the balance, while being arranged on the support such that, when the first bipolar magnet comes closer to the stationary bipolar magnet, identical polarities are facing each other to lead to a return force moment acting on the balance.

BACKGROUND OF THE INVENTION

An oscillator more or less corresponding to the features set out above has already been described, by accident, in utility model DE 1789976 U, which relates to different alternative embodiments of an oscillator of the electromagnetic type. The embodiment of FIG. 2 relates to a pendulum comprising an arm whereof the free end bears a magnet intended to cooperate with reels to sustain the oscillations of the pendulum. The arm further bears an additional magnet, in its central part, intended to cooperate with a stationary magnet, the position of which is adjustable in reference to the frame of the clockwork movement, such that a fine adjustment of the specific frequency of the oscillations is made possible by modifying the position of the stationary magnet in reference to the trajectory of the magnet supported by the arm of the pendulum. This document sets out the possibility of implementing an alternative according to which this pendulum could theoretically oscillate in a sustained manner without the presence of the reels and therefore without the electromagnetic interaction sustaining the oscillations of the pendulum in the illustrated embodiment.

The present invention instead relates to the field of oscillators including a balance and intended to be implemented in a timepiece of the portable type, such as pocket watches or bracelet watches. The balance is generally associated with a balance-spring intended to lead to alternating return force moments to produce the oscillating movement.

Yet the manufacture of oscillators of the sprung balance type is delicate to master; in particular, producing the balance-springs requires very precise know-how that is not very widespread, which justifies the search for alternative solutions.

As an example, patent EP 1,805,565 B1 describes different embodiments of oscillators in which return forces are generated by one or several permanent magnets. More specifically, this document describes the construction of an oscillator including a balance or a pallet bearing at least one movable bipolar magnet associated with at least one stationary bipolar magnet, to generate return forces on the balance or on the pallet intended to act on an oscillating element, and in particular to reproduce the typical movement of a balance associated with a balance-spring, in the case of embodiments relative to balances. FIG. 11 shows an embodiment in which a small magnetized bar acts as a balance. This bar is arranged in a guide channel to perform a to-and-fro movement while being repelled on either side by the poles of a stationary permanent magnet. The cooperation mode of the magnetized bar with a pallet situated in a plane adjacent to that of the movements of the magnetized bar is not clearly specified and, overall, this embodiment appears to pertain more to a concept than a practical functional embodiment. The embodiment of FIG. 15 provides that the pallet itself bears two small permanent magnets arranged to cooperate with two stationary magnets to generate return forces on the pallet. Such a construction is supposed to lead to high-frequency oscillations of the pallet, for which it is probably difficult to ensure a good level of isochronism. In general, the embodiment proposed in this document breaks with the conventional constructions and require making significant changes to existing clockwork calibers to incorporate them.

BRIEF DESCRIPTION OF THE INVENTION

One primary aim of the present invention is to propose a construction making it possible to produce an oscillator for a clockwork movement, as described above, not including a balance-spring, and offering good chronometric results while having a simple, robust structure that is not very sensitive to variations in ambient temperature or to impacts. One additional aim of the present invention is to allow easy integration of the oscillator according to the invention into an existing clockwork caliber.

To that end, the present invention more particularly relates to an oscillator of the aforementioned type, characterized in that the suspended mass of the balance bears a second bipolar magnet having an arrangement similar to that of the first bipolar magnet, such that the first and second bipolar magnets are able to cooperate alternatingly with the stationary bipolar magnet to lead to opposite respective return force moments. Furthermore, the oscillator according to the invention includes a pallet and an escape-wheel intended to establish a kinematic link between an energy source of the clockwork movement and the balance, arranged such that the balance can have a sustained periodic oscillating movement with an amplitude greater than 90 degrees.

Owing to these features, and against all expectations, the basic principle of repulsion occurring between two magnets brought close to one another, with identical polarities opposite one another, makes it possible to generate a return force suitable for implementing an oscillator for a clockwork movement. Furthermore, the stationary magnet directly performs the mechanical banking function, thus eliminating any risk of seizing of the balance in case of impact.

Advantageously, the balance can be situated substantially in a first plane, the stationary bipolar magnet being situated in a second plane separate from the first plane.

Furthermore, the oscillator according to the present invention may include a balance-cock bearing a pivot mounting bearing of the balance arbor and to which the support of the stationary magnet is assembled.

In this case, the support may be assembled to the balance-cock such that its position and/or orientation can be adjusted in reference to the balance-cock.

According to one non-limiting preferred embodiment, it is possible to provide that the balance bears a pin arranged to cooperate with the pallet to sustain the oscillations of the balance.

Owing to these features, the oscillator according to the present invention can easily be implemented in relation to an existing clockwork caliber, without requiring excessive modifications.

In general, it is possible to provide that the first and second bipolar magnets have an angular gap between them comprised between 20 and 180 degrees. In this case, it may be advantageous to provide that at least one of the first and second bipolar magnets is assembled to the balance such that it can be moved to adjust the value of the angular gap.

The present invention also relates to a clockwork movement including an oscillator corresponding to the above features, as well as a timepiece provided with such a clockwork movement.

BRIEF DESCRIPTION OF THE DRAWINGS

Other features and advantages of the present invention will appear more clearly upon reading the detailed description of one preferred embodiment that follows, done in reference to the appended drawings, provided as non-limiting examples and in which.

DETAILED DESCRIPTION OF THE INVENTION

Figure 1:
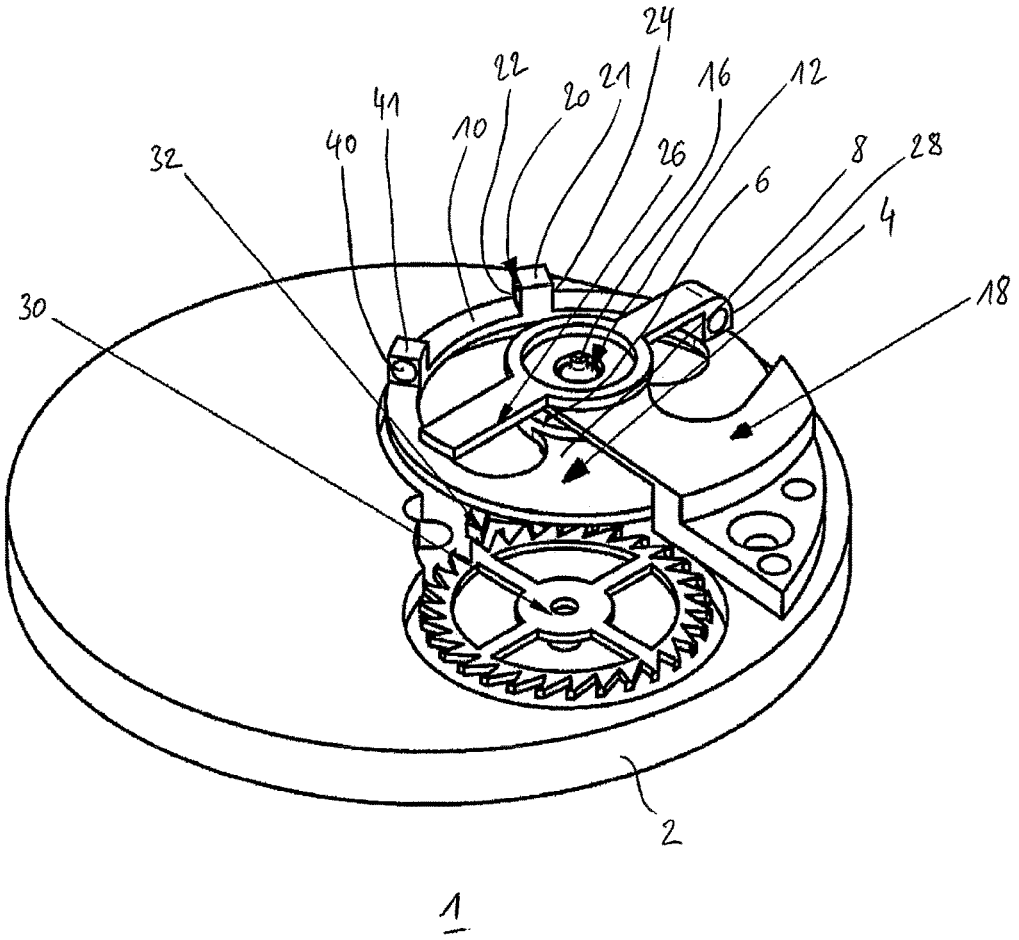
FIG. 1 shows a simplified perspective view of a clockwork movement including an oscillator according to one preferred embodiment of the invention.
Figure 2:
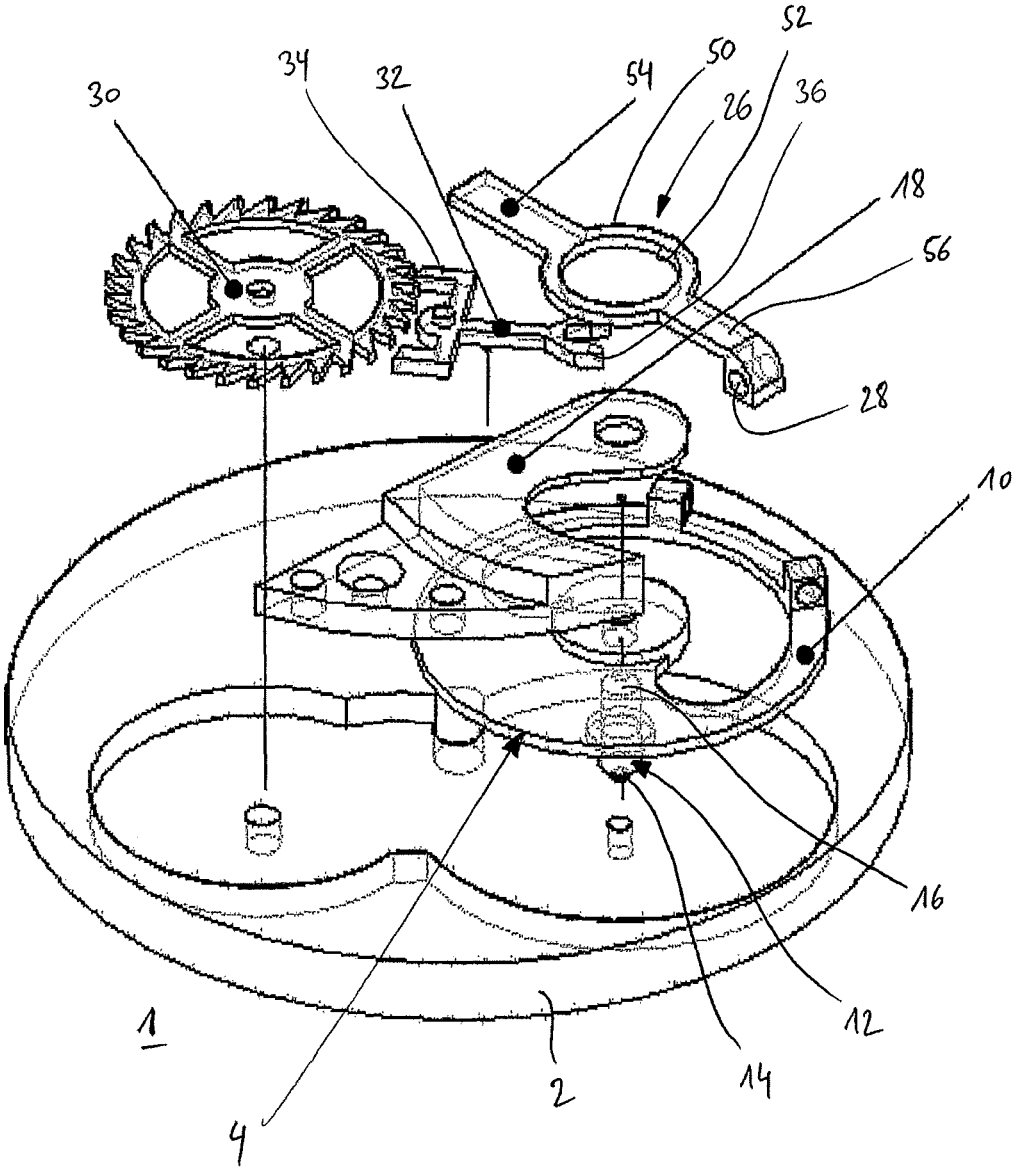
FIG. 2 shows a simplified and exploded perspective view of the clockwork movement of FIG. 1.

FIG. 1 shows a simplified perspective view of a clockwork movement including an oscillator 1 according to one preferred embodiment of the present invention, while FIG. 2 shows the clockwork movement of FIG. 1 in a similar, but exploded view, to show certain construction details.

The depiction of the clockwork movement is simplified in the figures to facilitate the comprehension of the features of the oscillator according to the invention.

The clockwork movement can be an existing caliber slightly modified to install the oscillator according to the invention therein, or alternatively, it may be a new caliber developed specifically, without going beyond the scope of the invention.

The clockwork movement includes a frame, in particular here a plate 2 machined conventionally to support all or part of the wheels of the movement. In particular, the plate typically supports an energy source, such as a spring housed in a barrel (not illustrated), intended to sustain the oscillations of the oscillator 1 via a going train (not illustrated).

The oscillator 1 includes a balance 4 with a substantially conventional general shape, i.e., it comprises a hub 6 from which at least one arm 8 extends making it possible to connect a rim 10 to the hub.

The balance 4 is secured to an arbor 12 by which it is mounted pivoting on the frame of the clockwork movement.

A first end 14 of the arbor 12 here is pivoted in a first bearing arranged in the plate 2, while the other end 16 of the arbor is pivoted in a second bearing arranged on a balance-cock 18, in turn assembled to the plate 2.

According to the present invention, the balance 4 bears at least one first bipolar magnet 20, arranged at a distance from the arbor 12. More specifically, the magnet 20 here is housed in an extension 21 arranged in an overthickness on the rim 10 of the balance 4. The magnet 20 has a magnetic orientation substantially tangential in reference to the balance 4, i.e., its first and second faces 22 and 24 have opposite polarities. For example, the first face 22 can be associated with the North pole of the magnet 20, while the second face 24 can be associated with its South pole.

Furthermore, the balance-cock 18 bears a support 26 arranged on the cock such that its angular orientation relative to the latter can be adjusted for purposes that will be explained later. The support 26 bears a stationary bipolar magnet 28 arranged such that it is situated near the rim 10 of the balance 4.

Thus, the first bipolar magnet 20 is able, based on the angular position of the balance 4, to be positioned within range of the magnetic field produced by the stationary bipolar magnet 28.

Indeed, the arrangement of the support 26 on the balance-cock 18 is done such that the stationary bipolar magnet 28 is situated on the trajectory of the first bipolar magnet 20, as it is defined by the pivoting of the balance 4. This trajectory is substantially in the form of a toroid portion adjacent to the rim 10 of the balance 4 and situated in a plane parallel to the latter.

Furthermore, the stationary bipolar magnet 28 is arranged on the support 26 such that, when the first bipolar magnet 20 comes closer to it, identical polarities are facing each other to lead to a repulsion force. This arrangement makes it possible to generate return forces on the balance, when it pivots, intended to reproduce the typical movement of a balance associated with a balance-spring.

It will be noted that the extension 21 can alternatively be positioned radially on the rim 10 rather than in an axial direction, without going beyond the scope of the invention. Such an alternative makes it possible to reduce the bulk of the balance in the direction of its thickness, but increases its overall diameter. The shape and dimensions of the support 26 will of course need to be adapted to the installation of the extension 21 on the balance 4, and one skilled in the art will not encounter any particular difficulty in adapting these elements based on his own needs.

Furthermore, the oscillator 1 according to the present invention includes a linking device, intended to establish a kinematic link between the energy source of the clockwork movement and the balance arbor 12, arranged such that the balance is able to have a sustained periodic oscillating movement.

As mentioned above, the clockwork movement typically includes a going train providing the link between the energy source and the oscillator.

Only an escape-wheel 30, driven by the going train, has been shown in figures. The escape-wheel 30 continuously receives a torque through its pinion (not shown), under the effect of the energy released by the energy source of the clockwork movement, still tending to rotate it in a same predefined rotation direction.

The escape-wheel cooperates conventionally with a pallet 32 pivoted on the frame of the clockwork movement. The pallet 32 typically has a fork 34 arranged to cooperate with the escape-wheel 30 and a dart 36 arranged to cooperate with an impulse-pin (not shown) secured to the balance 4. Thus, the balance 4 periodically actuates the pallet 32 in order to pivot it and free the escape-wheel 30, while the latter provides small impulses to the pallet in return to sustain the oscillations of the balance.

Of course, other embodiments can be considered regarding the linking device, without going beyond the scope of the invention.

As an example, it is possible to provide a mechanism of the type used in bidirectional automatic winding mechanisms implementing a simple reverser working with an intermediate wheel mounted on a lever to mesh alternately with first and second toothed wheels, directly for one and via an intermediate wheel for the other. Such a mechanism is for example described in the book entitled "Théorie d'horlogerie", by C.-A. Reymondin et al., published by the Federation des Ecoles Techniques (Switzerland), ISBN 2-940025-10-X, on page 178 (FIGS. 8-30 and 8-31), the teaching of which is incorporated into this disclosure by reference. The intermediate wheel mounted on the lever changes the toothed wheel it meshes with upon each change of rotation direction of the balance to allow energy to be transmitted to the balance during each of its vibrations.

One skilled in the art may implement alternative embodiments of the linking device without difficulty and without going beyond the scope of the invention.

In general, it is possible to provide alternative embodiments of the oscillator 1.

Thus, for example, it is possible to provide that the balance 4 bears a second bipolar magnet 40 housed in a second extension 41 similar to the extension 21. The second magnet 40 then has the same orientation as the first magnet 20, such that the magnets 20 and 40 alternately cooperate with the stationary bipolar magnet 28 to lead, each in turn, to a repulsion force making it possible to reverse the rotation direction of the balance 4. Furthermore, providing two magnets on the balance makes it possible to adjust the amplitude of the oscillations of the balance, by modifying the angular gap between the two magnets.

Preferably, it is possible to provide an angular gap of about 20 to 180 degrees, in order for the amplitude of the oscillations of the balance 4 to be comprised substantially between 180 and 340 degrees. Still more preferably, the angular gap may be comprised between 40 and 160 degrees.

Furthermore, the figures show that the balance 4 here comprises a single arm 8 having a large angular expanse to ensure balancing of the balance in terms of the masses, in particular to balance the mass of the extensions 21 and 41. Of course, other forms and/or solutions may be selected to provide the equilibration of the balance, without going beyond the scope of the present invention.

The support 26 may include a base 50, provided with a hole 52 for its assembly to the cock 18, from which first and second arms 54, 56 extend that are intended to be positioned with an angular orientation adapted in reference to the balance 4, which in turn is oriented angularly relative to the pallet 32 (in any case, the impulse-pin is positioned to have substantially symmetrical oscillations in reference to the straight line passing through the balance arbor and the rotation axis of the pallet).

The first arm 54 makes it possible to facilitate the gripping of the support 26 in order to modify the angular orientation thereof on the cock 18, similarly to conventional escapement indexes.

The second arm 56 has a bed, for the stationary bipolar magnet 28, here arranged perpendicular to the main direction of the second arm 56 such that the stationary magnet 28 is ultimately oriented substantially tangentially in reference to the rim 10 of the balance 4.

Owing to these features and the possibilities for adjusting the orientation of the support 26, not only can the stationary magnet 28 be positioned precisely on the trajectory of the magnets supported by the balance, but it further makes it possible to define a mechanical banking offering security against seizing of the balance in case of impact.

It will be noted that the bipolar magnet used to carry out the present invention can be made from standard commercially available magnets, and one skilled in the art will not encounter any particular difficulty in choosing magnets appropriate for his needs.

It will also be noted that the construction according to the invention makes it possible to simplify the design of the oscillator in reference to the known solutions, and further makes the oscillator less sensitive to variations in ambient temperature.

The preceding description endeavors to describe one particular embodiment as a non-limiting illustration, and the invention is not limited to the embodiment of certain particular features described above, for example the illustrated and described forms for the balance or the various supports described in relation with the different magnets. It will also be noted that one skilled in the art may also adapt this teaching to produce a linking device between the balance and the energy source of the clockwork movement meeting his own needs without going beyond the scope of the invention.

In general, one skilled in the art will not encounter any particular difficulty in adapting the content of this disclosure to his own needs and implementing an oscillator for a clockwork movement including a balance bearing at least one first magnet associated with a stationary magnet arranged on the trajectory of the magnet carried by the balance to generate a repulsion acting as return force during the rotation of the balance, without going beyond the scope of the present invention.

The invention claimed is:

1. An oscillator for a clockwork movement, including an arbor intended to be mounted on an element of a frame of the clockwork movement to define a rotation axis of a balance comprising a hub secured to a suspended mass, angularly extended, bearing a first bipolar magnet, arranged at a distance from said arbor, having magnetic poles which are oriented substantially in a tangential direction in reference to said arbor, and able, depending on the angular position of said balance, to be positioned within range of a magnetic field produced by at least one stationary bipolar magnet, secured to a support intended to be assembled to said frame of the clockwork movement, said stationary bipolar magnet being situated on the trajectory of said first bipolar magnet as defined by the rotation of said balance, while being arranged on said support such that, when said first bipolar magnet comes closer to said stationary bipolar magnet, identical polarities are facing each other to lead to a return force moment acting on said balance, said suspended mass of said balance bearing a second bipolar magnet having an arrangement similar to that of said first bipolar magnet, such that said first bipolar magnet and said second bipolar magnets are able to cooperate alternatingly with said stationary bipolar magnet to lead to opposite respective return force moments, and the oscillator further including a pallet and an escape-wheel designed to establish a kinematic link between an energy source of the clockwork movement and said balance and arranged such that said balance can have a sustained periodic oscillating movement with an amplitude greater than 90 degrees.

2. The oscillator according to claim 1, said balance being situated substantially in a first plane, wherein said stationary bipolar magnet is situated in a second plane separate from said first plane.

3. The oscillator according to claim 1, further including, a balance-cock bearing a pivot mounting bearing of said arbor and to which said support is assembled.

4. The oscillator according to claim 3, wherein said support is assembled to said balance-cock such that its position and/or orientation can be adjusted in reference to said balance-cock.

5. The oscillator according to claim 1, wherein said balance bears a pin arranged to cooperate with said pallet to sustain the oscillations of said balance.

6. The oscillator according to claim 1, wherein said first bipolar magnet and said second bipolar magnets have an angular gap between them comprised between 20 and 180 degrees.

7. The oscillator according to claim 6, wherein at least one of said first bipolar magnet and said second bipolar magnet is assembled to said balance such that it can be moved to adjust the value of said angular gap.

8. A clockwork movement including an oscillator according to claim 1.

9. A timepiece including a clockwork movement according to claim 8.

10. The oscillator according to claim 2, further including a balance-cock bearing a pivot mounting bearing of said arbor and to which said support is assembled.

11. The oscillator according to claim 10, wherein said support is assembled to said balance-cock such that its position and/or orientation can be adjusted in reference to said balance-cock.

12. The oscillator according to claim 2, wherein said balance bears a pin arranged to cooperate with said pallet to sustain the oscillations of said balance.

13. The oscillator according to claim 3, wherein said balance bears a pin arranged to cooperate with said pallet to sustain the oscillations of said balance.

14. The oscillator according to claim 4, wherein said balance bears a pin arranged to cooperate with said pallet to sustain the oscillations of said balance.

15. The oscillator according to claim 11, wherein said balance bears a pin arranged to cooperate with said pallet to sustain the oscillations of said balance.

16. The oscillator according to claim 2, wherein said first bipolar magnet and said second bipolar magnet have an angular gap between them comprised between 20 and 180 degrees.

17. The oscillator according to claim 4, wherein said first bipolar magnet and said second bipolar magnet have an angular gap between them comprised between 20 and 180 degrees.

18. The oscillator according to claim 11, wherein said first bipolar magnet and said second bipolar magnet have an angular gap between them comprised between 20 and 180 degrees.

19. A clockwork movement including an oscillator according to claim 4.

20. A timepiece including a clockwork movement according to claim 19.

* * * * *